US009546067B2

(12) United States Patent
Rinke et al.

(10) Patent No.: US 9,546,067 B2
(45) Date of Patent: Jan. 17, 2017

(54) METHOD AND DEVICE FOR FORMING PRODUCT STACKS OF FOLDED OR UNFOLDED PRODUCT BLANKS MADE OF PAPER, CHEMICAL PULP OR THE LIKE

(71) Applicant: Winkler + Dünnebier GmbH, Neuwied (DE)

(72) Inventors: Andreas Rinke, Bad Oldesloe (DE); Rolf Majeweski, Erpel (DE); Konrad Popp, Augsburg (DE); Thorsten Tews, Kruft (DE); Frank Jungbluth, Arbrück (DE); Jürgen Vieweg, Sankt Sebastian (DE); Wolthmann Cord, Wentdorf bei Hamburg (DE)

(73) Assignee: WINKLER + DÜNNEBIER GMBH, Neuwied (DE)

( * ) Notice: Subject to any disclaimer, the term of this patent is extended or adjusted under 35 U.S.C. 154(b) by 89 days.

(21) Appl. No.: 14/442,566

(22) PCT Filed: Nov. 12, 2013

(86) PCT No.: PCT/EP2013/003404

§ 371 (c)(1),
(2) Date: May 13, 2015

(87) PCT Pub. No.: WO2014/075790

PCT Pub. Date: May 22, 2014

(65) Prior Publication Data

US 2016/0289038 A1 Oct. 6, 2016

(30) Foreign Application Priority Data

Nov. 14, 2012 (DE) ..... 10 2012 022 228

(51) Int. Cl.
*B65H 29/40* (2006.01)
*B65H 31/32* (2006.01)
(Continued)

(52) U.S. Cl.
CPC ..... *B65H 29/40* (2013.01); *B65H 31/06* (2013.01); *B65H 31/309* (2013.01); *B65H 31/32* (2013.01);
(Continued)

(58) Field of Classification Search
CPC ..... B65H 29/40; B65H 31/06; B65H 31/36; B65H 31/309; B65H 2701/1924; B65H 2301/4214; B65H 31/32
(Continued)

(56) References Cited

U.S. PATENT DOCUMENTS 3,298,683 A * 1/1967 Stroud ..... B65H 31/32 271/189
5,358,232 A 10/1994 Arendes et al.
(Continued)

FOREIGN PATENT DOCUMENTS

DE 41 17 434 12/1992
DE 101 12 942 9/2001
(Continued)

OTHER PUBLICATIONS

International Search Report issued by the European Patent Office in International Application PCT/EP2013/003404 on Feb. 27, 2014.

*Primary Examiner* — Patrick Cicchino
(74) *Attorney, Agent, or Firm* — Henry M. Feiereisen LLC.

(57) ABSTRACT

In a method for forming product stacks of folded or unfolded product blanks made of paper or chemical pulp, product blanks are supplied consecutively to a stacking surface and placed in an upright position. A separating element is inserted between two consecutive product blanks as the product blanks are moved against a channel wall of a discharge channel for temporary support of a rear side of the product blanks, to thereby form a first product stack with a
(Continued)

predetermined number of product blanks between the separating element and the channel wall. The channel wall is opened to thereby allow the first product stack to be transferred to the discharge channel, and a sliding element is inserted between the product stack and a subsequent second product stack, as the first product stack is moved to the discharge channel.

9 Claims, 4 Drawing Sheets

(51) Int. Cl.

| | |
|---|---|
| ***B65H 33/02*** | (2006.01) |
| ***B65H 31/06*** | (2006.01) |
| ***B65H 31/30*** | (2006.01) |
| ***B65H 31/36*** | (2006.01) |

(52) U.S. Cl.
CPC ..... *B65H 31/36* (2013.01); *B65H 33/02* (2013.01); *B65H 2301/4214* (2013.01); *B65H 2701/1924* (2013.01)

(58) Field of Classification Search
USPC ..... 271/218
See application file for complete search history.

(56) References Cited

U.S. PATENT DOCUMENTS

| | | | | |
|---|---|---|---|---|
| 5,421,700 | A * | 6/1995 | Kranz | B65H 29/40 271/2 |
| 8,240,653 | B2 * | 8/2012 | Walsh | B65H 31/32 270/39.01 |
| 9,096,404 | B2 * | 8/2015 | Duchstein | B65B 5/106 |
| 2014/0331612 | A1 * | 11/2014 | Jeschke | B65H 31/309 53/447 |

FOREIGN PATENT DOCUMENTS

| | | |
|---|---|---|
| EP | 0 553 724 | 8/1993 |
| EP | 1 195 324 | 4/2002 |
| EP | 2 206 663 | 7/2010 |

* cited by examiner

METHOD AND DEVICE FOR FORMING PRODUCT STACKS OF FOLDED OR UNFOLDED PRODUCT BLANKS MADE OF PAPER, CHEMICAL PULP OR THE LIKE

CROSS-REFERENCES TO RELATED APPLICATIONS

This application is the U.S. National Stage of International Application No. PCT/EP2013/003404, filed Nov. 12, 2013, which designated the United States and has been published as International Publication No. WO 2014/075790 and which claims the priority of German Patent Application, Serial No. 10 2012 022 228.9, filed Nov. 14, 2012, pursuant to 35 U.S.C. 119(a)-(d).

BACKGROUND OF THE INVENTION

The invention relates to a method for forming product stacks of folded or unfolded product blanks made of paper, chemical pulp or the like. It additionally relates to a device, in particular for carrying out the method.

In many applications, for example in the paper-processing industry or in the production of hygiene products, product blanks are produced from paper, chemical pulp, non-woven material or the like. In this case, for example when producing envelopes from paper or when producing pocket tissues or the like, the product blanks, in an unfolded state or also in a folded state, can be made of chemical pulp. Such products, in particular hygiene products, are conventionally produced in particularly large quantities, and after folding, packaged in suitably selected packaging sizes, for example in packs of 5 or 10 or even 15. For this purpose, in suitable packaging systems, suitably dimensioned product stacks, i.e. dimensioned according to the provided intended use, for example product stacks of 5 or 10, are firstly formed from the blanks and are subsequently supplied to the actual packer, where they are wrapped for example in a blown film bag or the like.

A method and a device for forming product stacks from product blanks of this type is known for example from DE 41 17 434 A1. In this known system, it is provided to place the product blanks upright on a stacking surface, and further transport subsequently takes place in stacks by means of a plurality of stack supports. This known system is intended for processing envelopes, wherein with regard to the desired exceptionally high quantities and throughputs, in relation to the design of the equipment, the load-bearing capacity of the product blanks is based on paper as the base material. In particular, envelopes have a more uniform geometry by comparison with tissue products and have greater mechanical stability than the rather soft tissue products due to the paper which is used as the base material. Due to the upright orientation of the envelopes directly before the separation thereof into the desired stack quantities, processing without format parts is thus made possible in a particularly simple manner. This means that the stack quantity can be changed, for example due to a change in the requirements in the production process whereby the number of product blanks which are to be grouped together into respective stacks is changed, in a particularly simple manner and without substituting system components. The change in the stack quantity can be carried out in particular by simply changing the point at which the separator is inserted into the series of upright envelopes. However, it is desirable to also achieve such separation without format parts in an automated stack-forming process when chemical pulp is used as the base material, as is used for example in the production and the packaging of pocket tissues, hygiene products, sanitary pads, pantyliners or the like.

The object of the invention is therefore that of providing a method of the above-mentioned type which allows, in a particularly simple and reliable manner, particularly high flexibility in the formation of the product stacks whilst also keeping the stress on the material to be processed low. In addition, a device for carrying out the method is to be provided.

SUMMARY OF THE INVENTION

With regard to the method, this object is achieved according to the invention in that the product blanks to be stacked are supplied consecutively to a stacking surface and are placed upright thereon, wherein, when the product blanks are placed down, a separating element is inserted between two consecutive product blanks such that the product stack being formed between the separating element and the channel wall has a predetermined number of product blanks, and wherein, after the Insertion of the separating element, the channel wall is opened such that the product stack formed between the separating element and the channel wall can be inserted into the discharge channel. Advantageously, after the product blanks are placed on the stacking surface, the rear side of said blanks is supported temporarily by a channel wall of a discharge channel.

In this case, the invention proceeds from the idea that in order to achieve high flexibility when processing the product blanks for the purpose of forming stacks, the fundamental concept of stack forming should be based on an upright orientation of the product blanks. A separation of the desired product stack from the delivered flow of tissues or products is possible in this case in that a separating element is inserted in the vertical direction between two adjacent product blanks, wherein what is known as a format change, i.e. a change in the stack size or the number of individual product blanks which are grouped together into a stack, can be made possible in a particularly simple manner and without altering the mechanical components by simply changing the point at which the separating element is inserted. In order in this case to ensure high reliability of the system in the case of the desired high production or throughput rates for the chemical pulp material of pocket tissues or the like, which material has a comparatively low loading capacity, the support of the upright product blanks should be continuously ensured during the stack formation. This can be achieved by particularly simple means in that the channel wall of a secondary discharge channel is used as a means for supporting the product stacks.

After the insertion of the separating element between the product blanks, i.e. after the desired separation of the stack has taken place, said channel wall can then be opened so that the product stack formed between the separating element and the channel wall can be moved into the discharge channel which is located behind the channel wall and from there can be transported further.

In order to allow the product blanks, which are to be stacked, to be supplied to the stacking surface in the manner of a continuous, uninterrupted product flow, after the separating element has been inserted between the product blanks, said separating element is advantageously moved towards the channel wall. By means of this movement of the separating element in the substantially horizontal conveying direction of the product blanks towards the discharge channel, additional space is provided on the stacking surface in front of the separating element, on which space additional conveyed product blanks can be placed.

After the channel wall has been opened, the product stack formed between the separating element and the channel wall is inserted into the discharge channel. In order to make this possible in a particularly simple manner a sliding element is advantageously inserted, in addition to the separating element, between the product blanks delimiting the product stack on one side and the product stack following said product stack on the other side, in order to insert the product stack into the discharge channel. The sliding element can subsequently also be moved towards the discharge channel in the conveying direction of the product blanks so that the product blanks located between said element and the channel wall are inserted into the discharge channel. During this process of inserting the product stack into the discharge channel, advantageously the rear side of the consecutive new product stack being produced by the additional inflow of product blanks onto the stacking surface is supported temporarily by the separating element. As soon as the process of inserting the already formed product stack into the discharge channel has ended, the channel wall can be closed again, and the separating element and the sliding element can be pushed out of the region of the product blanks by respectively vertical movements. The channel wall which is closed again thus takes over the function of supporting the rear side of the product stack being formed, and the separating element can be suitably inserted between the product blanks again in order to suitably separate the new product stack being formed.

Advantageously, the formation of the product stack takes place in two or more processing lines which run parallel to one another in terms of processes and are assigned to a common discharge channel. The product blanks which are grouped together in two or more processing lines into product stacks are advantageously inserted into a common discharge channel.

With regard to the device, the stated object is achieved according to the invention by a stacking surface which is upstream of a discharge channel and from which a product stack can be inserted into the discharge channel, wherein the channel wall of the discharge channel facing the stacking surface is suitably designed for temporary opening. Advantageously, the device comprises a separating element which can be inserted between two product blanks and is mounted so as to be movable in a direction which is transverse to the conveying direction of the product stack, preferably in a substantially vertical insertion direction. In an additional, particularly preferred embodiment, said separating element is additionally mounted so as to be movable in a substantially horizontal conveying direction of the product stack so that said element can participate in the movement taking place as a result of the further conveying of the product blanks.

Advantageously, the device comprises a sliding element which can be inserted between two product blanks, is mounted so as to be movable in a direction transverse to the conveying direction of the product stack, preferably in a substantially vertical insertion direction, and which, in a particularly preferred additional embodiment, is mounted so as to be movable in a substantially horizontal conveying direction of the product stack.

In order to allow the product stack already formed between the separating element and the channel wall to be inserted in the defined, desired manner into the discharge channel when the channel wall is open, wherein additionally the separating element is intended to be used temporarily as a support for the consecutive product blanks, in a particularly preferred embodiment, the sliding element, when viewed in the conveying direction of the product stack, can move at a greater speed than the separating element.

In an additional advantageous embodiment, the sliding element and/or the separating element is in the form of a sliding rake or separating rake. By designing the two elements as rakes, it is can thus be achieved that when the two components are inserted between the product blanks from opposite sides, the teeth of the rakes can interlock so that it is possible to insert the two components without obstruction.

By means of the mentioned embodiment of the method and of the system provided for carrying out the method, particularly high flexibility in the formation of the product stacks is made possible, in particular with regard to different stack sizes or different numbers of the product blanks to be grouped together into stacks, wherein, with regard to the mechanical stresses of the material to be processed, the processing process is selected so as to be suitable specifically also for the properties of chemical pulp or the like. The design of the system is based substantially on the concept that the product flow of the machine which is designed for example as a pocket tissue machine, in the region where tissues are deposited, is composed of a suitable individual tissue transport unit, preferably what is known as a serrated disc, a suitable guide unit which is intended to comb out and guide the individual tissues, and a subsequent unit for separating the continuously produced flow of tissues into defined stack quantities. In this case, the separating unit, which fulfils in particular the function of what is known as an inserter, and the slider are provided, the slider conveying the separated product stack away into the subsequent discharge channel. The movement profile of the inserter and the slider is assigned and adapted to the specific working positions.

In an embodiment which is conventional per se, the individual tissue transport unit, more particularly the serrated disc, comprises a constant number of cavities, in which each individual tissue is received. Each cavity is provided with teeth having a defined contour which ensure secure guiding during the further transport of each individual tissue. In a particularly advantageous development, which is an independently inventive embodiment of the serrated disc, a vacuum suction hole is provided in the cavities at the respective groove bases of the teeth, by means of which hole the tissue can be temporarily held in the cavity. This makes it possible for the serrated disc to convey the tissues in an upwards movement, i.e. from the bottom up, to the stacking surface.

The separating element which is provided in the manner of an inserter thus fulfils the function of separating the stipulated stack quantity from the continuously supplied flow of tissues in which the individual tissues are placed in a vertical orientation. In this phase, that is to say when and as long as the separating element provided as an inserter is inserted between the product blanks and thus separates the product stack from the consecutive flow of tissues, the separating element takes over the function of supporting the subsequent product blanks and, as a result of the movement of the separating element towards the channel wall, moves out of the way of the growing number of consecutive tissues placed on the stacking surface. The movement profile in this case is comparatively slow, i.e. is suitably determined according to the tissue thickness of the supplied tissues.

In the process, the separating element, which accordingly moves further, prevents the Individual products from falling. After reaching a limit position which, in the chronological sequence, corresponds approximately to the time at which the already formed product stack has been completely inserted into the discharge channel, and the channel wall has been closed again, the separating element acting as an inserter dips laterally, preferably downwards, next to or under the product-guiding region and returns to its starting position. At the end of this return movement, the separating element changes its direction of movement transversely to the conveying direction of the product flow and starts to move upwards. In this case, the movement profile of the separating element is advantageously determined such that the contact surfaces thereof which come into contact with the products are moved in sync with the product-conveying components of the individual tissue transport unit, that is to say in particular of the serrated disc, so that there is little to no speed difference between the product blanks which are moved towards the depositing position of the stacking surface. It is thus achieved that the individual tissue currently being supplied to the stacking surface does not come into contact with the separating element when it is being supplied to the stacking surface so that the separating element can be inserted without obstruction between the product blank currently being supplied and the already deposited product blank.

When the separating element has reached its end position between the product blanks, its direction of movement is changed such that it moves in parallel with the conveying direction of the product blanks. At the start of this phase, the separating element advantageously briefly comes to a stop or slows down so that the sliding element which is arranged above or on either side of the separating element can dip into the product plane without coming into contact with the product blanks. After the completion of this process, the separating element or the inserter starts moving again at a considerably reduced speed as a "movable rear wall" in parallel with the conveying direction of the product blank so that the movement cycle can start from the beginning. Overall, the separating element carries out a "rectangular" movement. The movement profile, in an advantageous embodiment, is cam-controlled by a servo drive.

By contrast, the sliding element fulfils the function of inserting the already separated product stack into the discharge channel. The sliding element overall also performs a "rectangular" movement. In its rest position, the sliding element is located above or next to the product guiding plane. Triggered by a suitable starting signal, the sliding element then starts to accelerate in parallel above or next to the product plane in order to then dip into the product plane in the waiting separating slide, without coming into contact with the product. After reaching the end position between the product blanks, a signal to open the movable channel wall is advantageously given via a sensor and said wall is opened so that the insertion of the product stack into the discharge channel is made possible. As soon as the products are inserted into the discharge channel, the direction of movement of the sliding element changes so as to be a movement upwards or to the side. At the same time, the process of closing the discharge channel is initiated in that the movable channel wall thereof moves back into the closed position. In this phase, the channel wall can again take over the function of supporting the product blanks forming the consecutive product stack so that the separating element can also be moved out of the product conveying region.

The design of the discharge channel as a system comprising a movable channel wall, which is incidentally considered to be an independently inventive concept, firstly has the advantage that the movable channel wall can be used such that it performs a double function, both as an actual channel wall and as a temporary support element for the product stack being formed. In addition, however, a channel system designed in this manner for discharging the product stacks formed also provides additional advantages in terms of the process. Firstly, the discharge channel can be in the form of a common channel system for a plurality of upstream stack units, wherein expediently, the discharge direction in the channel system is oriented transversely to the conveying direction of the products in the respective stack units, preferably rotated by 90° with respect to the conveying direction of the products in the stack units. Therefore for example a plurality of stack units running in parallel can open into the channel system, wherein the product stacks can be suitably inserted in sync with one another into the channel system such that during the further conveying in the discharge system, the desired register-true timing for the purpose of uniform processing of the product stack is ensured. A simultaneous, parallel entry of a plurality of supply systems into the channel and a single-line, register-true output from the channel system is thus made possible. For these stated purposes, the one side wall of the channel is expediently designed having a wall which can be moved in the vertical direction and preferably opens and closes in cycles in coordination with other process operations. In order to insert the products into the channel, the sliding wall is lowered, and as soon as the stack is completely inserted, the wall is brought into the upper end position. In this state, said wall remains closed until the products are pushed out laterally via the discharge channel.

An embodiment of the invention will be described in greater detail with reference to the drawings, in which:

BRIEF DESCRIPTION OF THE DRAWING

The same parts are provided with the same reference numerals in all the drawings.

Figure 1:
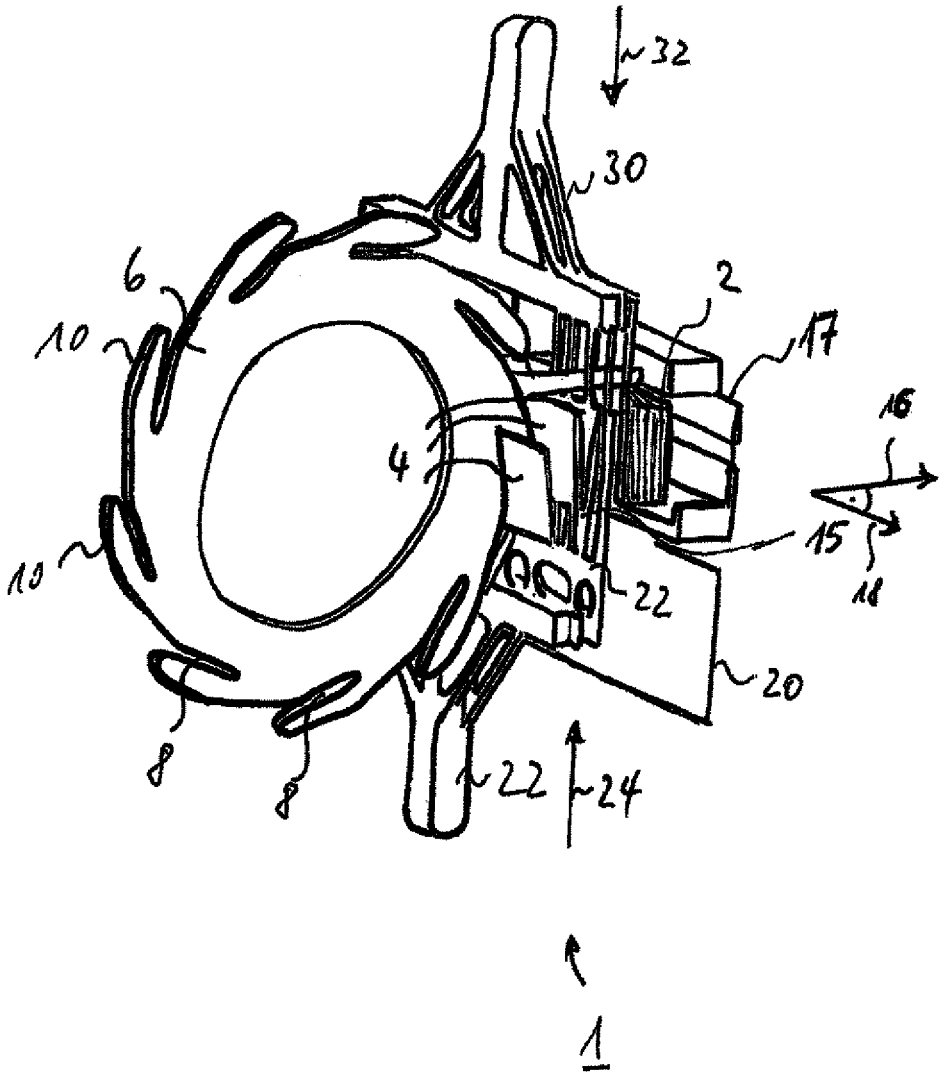
FIG. 1 shows a device for forming product stacks of product blanks.

The device 1 according to FIG. 1 is provided to form product stacks 2 from a plurality of product blanks 4 which are firstly supplied individually. In the embodiment, the product blanks 4 are paper pocket tissues, that is to say product blanks 4 made of chemical pulp which are to be portioned ready for sale in a subsequent packaging system, for example are to be packaged in packaging units of packs of 5 or 10.

DETAILED DESCRIPTION OF PREFERRED EMBODIMENTS

Accordingly, the individually supplied product blanks 4, that is to say the individual pocket tissues, are grouped together in the device 1 into product stacks 2 which each comprise five or ten individual pocket tissues. Alternatively, the device 1 could of course also be provided for forming stacks of other products such as hygiene products, pantyliners, sanitary pads or the like or also for products made of paper such as envelopes or the like.

The device 1 is provided for separating and forming stacks of the product blanks 4 in a substantially vertical orientation, that is to say upright. For this purpose, the device 1 comprises a supply unit for the individual pocket tissues or the individual product blanks 4. The supply unit is designed in the embodiment as what is known as a serrated disc 6, as is used in a perfectly conventional manner for such purposes. The serrated disc 6 comprises in this case cavities 8 which are distributed in a suitably positioned and contoured manner over the circumference thereof and are formed by suitably contoured teeth 10. The contour of the teeth 10 and of the cavities 8 formed thereby is selected such that the folded paper pocket tissues or product blanks 4 to be transported can be reliably held, guided and further transported along the circumference of the serrated disc 6.

Figure 2:
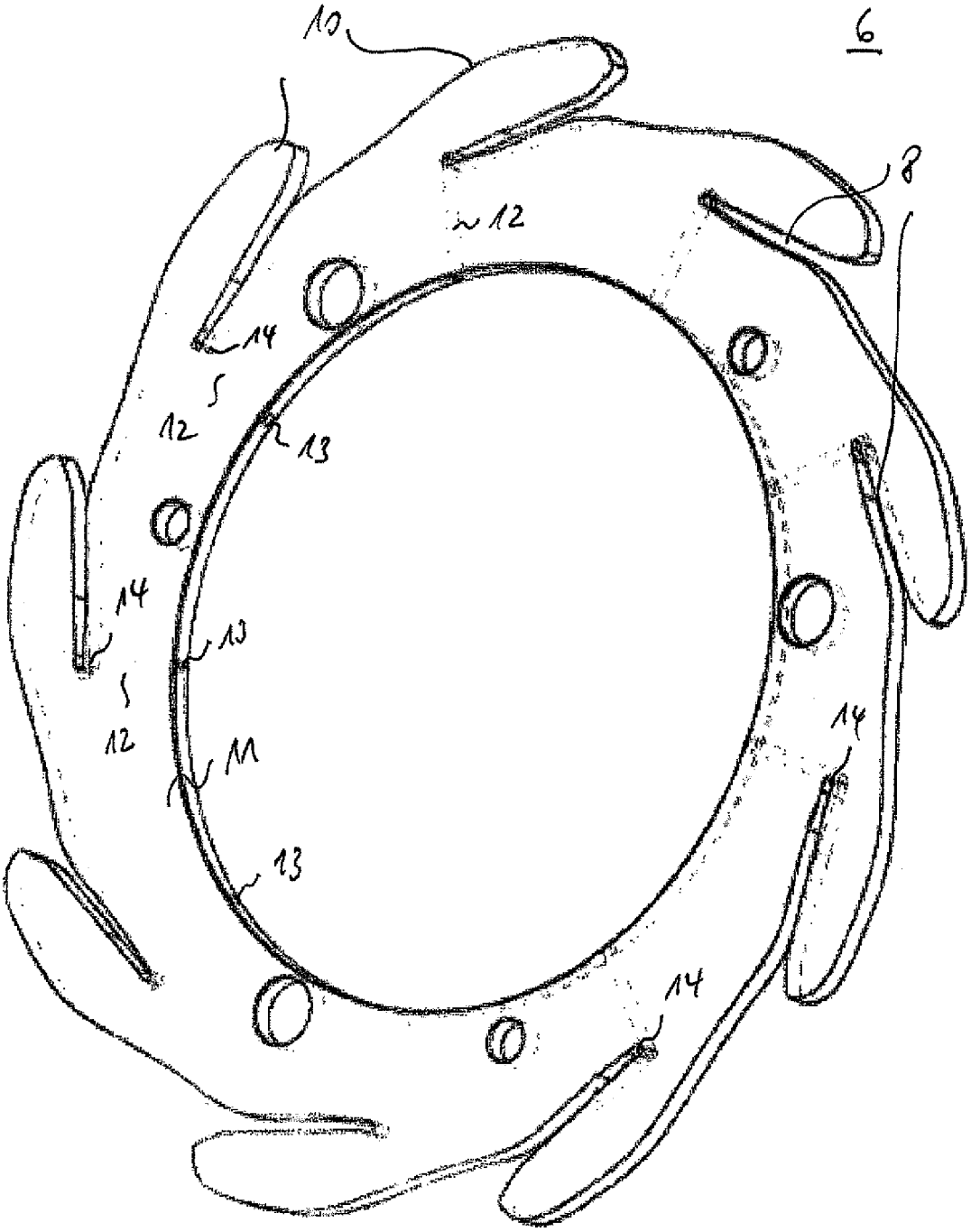
FIG. 2 shows a serrated disc of the device according to FIG. 1.

As a result of the rotation of the serrated disc 6, said disc guides the product blanks 4 from the bottom up to an output position. This embodiment allows for a particularly advantageous process operation, since when the product blanks 4 are placed down, a comparatively low end speed of the product blanks 4 in the vertical direction can be achieved, as a result of gravity, directly before the actual placing down. In order to make this operation possible, that is to say in particular the guiding from the bottom up to the output position, without there being a risk of the product blanks 4 falling out of the cavities 8, the serrated disc 6 is designed in a specific manner which is considered to be independently inventive, as can be seen in the enlarged view in FIG. 2. Since in particular in the mentioned guiding from the bottom up of the product blanks 4 to the output position thereof, both centrifugal force, occurring as a result of rotation, and gravity are to be expected, which could both cause the respective product blanks 4 to fall out of the corresponding cavity 8, the serrated disc 6 is designed to at least temporarily apply a retaining force which fixes the product blanks 4 in the respective cavity 8.

In the embodiment, the application of this retaining force is provided by means of a suction vacuum. For this purpose, in the main body 11 of the serrated disc 6, a vacuum channel 12 is integrated for each cavity 8, which channel connects a suction hole 13 which is arranged on the inner side of the serrated disc 6 to an intake hole 14 which opens out into each cavity 8. By means of an assigned negative pressure system, the intake holes 14 have a vacuum applied thereto in a timed manner such that in the phase of conveying a product blank 4 in the serrated disc 6, said blank is fixed in the respective cavity 8 by means of the vacuum. Shortly before reaching the output position, the suction vacuum in each cavity 8 is switched off and each product blank 4 is thus "released" so that said blank can subsequently be output and placed down.

In FIG. 1, for the sake of clarity, only one of the product blanks 4 is shown in the region of the output position in the respective cavity 8. In the output position, the serrated disc 6 places each supplied product blank 4 in an upright or on-edge orientation on a stacking surface 15 in the stated manner, which surface is formed in the embodiment by a plurality of conveyor belts which are guided in parallel with one another and are not visible in the drawing. By means of said belts, the supplied product blanks 4 which are placed upright are transported in a transport direction or conveying direction indicated by the arrow 16 to an assigned discharge channel 17. The discharge channel 17 is designed to transport the products further in a discharge direction which is transverse to the conveying direction or at an angle of 90° to the conveying direction and is represented by the arrow 18.

This removal of the product blanks 4 is intended to take place in stacks, that is to say in the form of the product stacks 2, in the discharge channel 17. In order to make this possible, the device 1 is designed for a suitable stack formation from the product blanks 4. In order to carry out the stack formation and the subsequent feed into the discharge channel 17, the discharge channel 17 is designed having a movable side wall or channel wall 20. During the removal of the products, the channel wall 20 is essentially closed so that reliable lateral support of the product stacks 2 transported in the discharge channel 17 is ensured. However, in the embodiment according to FIG. 1, for the sake of better comprehension, the discharge channel 17 is shown in a phase in which the channel wall 20 is temporarily open, so that it is possible to insert the finished product stack 2 into the discharge channel 17.

During the stack formation, the channel wall 20 is firstly closed and in the process is used to support the rear side of the product stack 2 which is being formed from the supplied product blanks 4. In order to form the product stack 2, a separating element 22 which is designed in the form of a rake is provided, which, based on the conveying direction of the product blanks 4 which is represented by the arrow 14, can be inserted between two consecutive product blanks 4 transversely to said conveying direction in an insertion direction represented by the arrow 24. In the embodiment according to FIG. 1, an insertion of the separating element 22 from the bottom up, that is to say in the vertical direction, into the product flow is provided; alternatively however, an insertion from the side could of course also be provided. In the case of the separating element 22 which is inserted into the product flow, said element separates the already formed product stack 2 from the consecutive additional supplied product blanks 4. After the insertion of the separating element 22 into the product flow, as shown in FIG. 1, the channel wall 20 is opened so that the product stack 2 originally located between the channel 20 and the separating element 22 can be inserted into the discharge channel 17.

In this phase, that is to say when the channel wall 20 is open and the product stack 2 can be inserted into the discharge channel 17, the separating element 22 acts as a support for the consecutively arriving product blanks 4 in the manner of a "movable rear wall". The separating element 22 is accordingly additionally mounted so as to be movable in the conveying direction of the product blanks 4 which is represented by the arrow 14. In order to provide sufficient space for the consecutively arriving additional product blanks 4 to be placed on the stacking surface 12, after the channel wall 20 has been opened, the separating element 22 moves towards the discharge channel 17 at a comparatively slow speed in the conveying direction represented by the arrow 14; the speed of said movement of the separating element 22 is such that the separating element 22 forms a "movable rear wall" for the continuous support of the new product stack 2 being formed, which stack is increasingly large as a result of the new product blanks 4 being added.

For the actual introduction of the product stack 2 into the discharge channel 17, the device 1 comprises another sliding element 30 which is likewise in the form of a rake. In this case, in the embodiment the sliding element 30 can be inserted, in the same manner as the separating element 22, in an insertion direction which is represented by the arrow 32, vertically from the top down, and thus also transversely to the conveying direction of the product blanks 4 which is represented by the arrow 14, likewise between the product blanks 4 delimiting the product stack 2 on one side and the product stack following said product stack on the other side. In the embodiment, the fact that both the separating element 22 and the sliding element 30 are in the form of rakes makes it possible for the respective teeth of said rakes, which are positioned so as to be laterally offset in a suitable manner with respect to one another, can interlock in a suitable manner, so that it is possible to insert both the separating element 22 and the sliding element 30 at the same point of separation between two adjacent product blanks 4 without obstruction.

After the insertion, the sliding element 30 is subsequently moved towards the discharge channel 17 in the conveying direction of the product blanks 4 at a speed which is selected to be suitably higher by comparison with the speed of the separating element 22 and thereby inserts the already formed product stack 2 into the discharge channel 17.

Figure 3A:
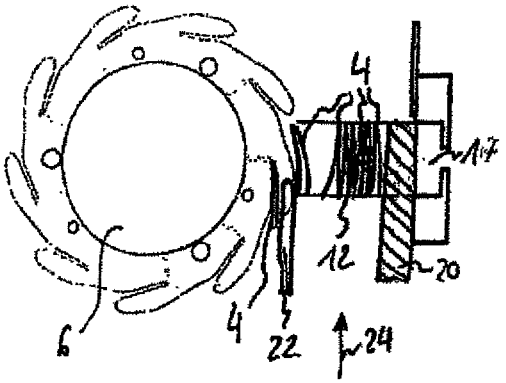
FIGS. 3 *a* to *f* show the device according to FIG. 1 in a plurality of moments during the process operation.

The movement sequence of the components is shown schematically in a lateral view in the sequence of FIG. 3*a* to 3*f*. In FIG. 3*a*, firstly the state is shown in which the serrated disc 6 has already placed a plurality of product blanks 4 upright on the stacking surface 12. In FIG. 3*a*, the channel wall 20 of the discharge channel 17 is still closed, so that in this phase, the rear side of the product blanks 4 which have already been placed down in an upright manner can be supported temporarily by the channel wall 20. FIG. 3*a* also shows the separating element 22 in the form of a rake, which, at the moment shown in FIG. 3*a*, is moved towards the stacking surface 12 substantially in parallel with the movement profile with which the serrated disc 6 supplies the product blanks 4 to said surface. Accordingly, the separating element 22 in the situation shown in FIG. 3*a* is moved in the insertion direction represented by the arrow 24 from the bottom up and is thereby inserted between two consecutive product blanks 4. The movement of the separating element 22 takes place, in terms of directional guiding and movement speed, in sync with the movements of the product blanks 4 such that said movement can be kept substantially free of contact and thus free of obstruction.

Figure 3B:
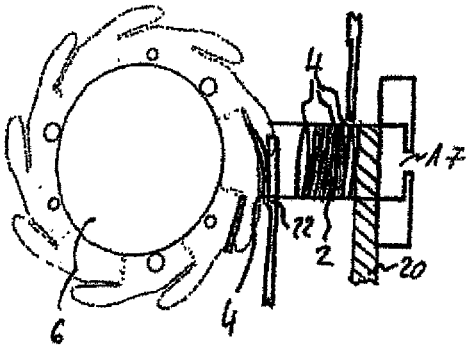

Shortly after, as shown in FIG. 3*b*, the separating element 22 is moved completely upwards into the end position thereof and thus separates the already formed product stack 2 from the additional product blanks 4 which are subsequently supplied by the serrated disc 6. In this phase, the channel wall 20 of the discharge channel 17 is still closed and additionally supports the rear side of the product blanks 4 which have been placed down. Directly thereafter, as can be seen in the moment in FIG. 3*c*, the separating element 22 is moved towards the discharge channel 17 and thus towards the channel wall 20 at a comparatively slow speed in the conveying direction of the product blanks 4 which is represented by the arrow 14. The separating element 22 thus becomes a "movable rear wall" for the new product blanks 4 which are arriving, which wall increasingly moves out of the way towards the channel wall 20 and thus provides more and more space on the stacking surface 12 for new product blanks 4 which are arriving.

Figure 3C:
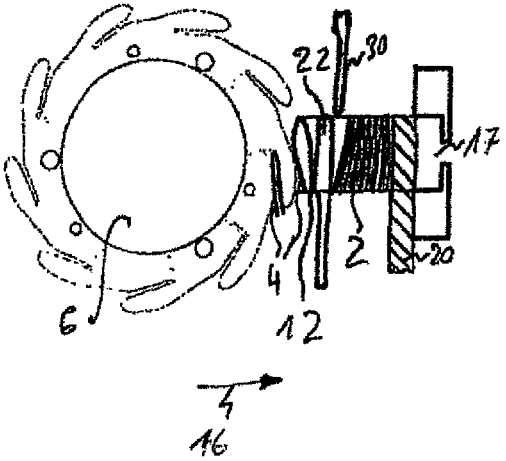
Figure 3D:
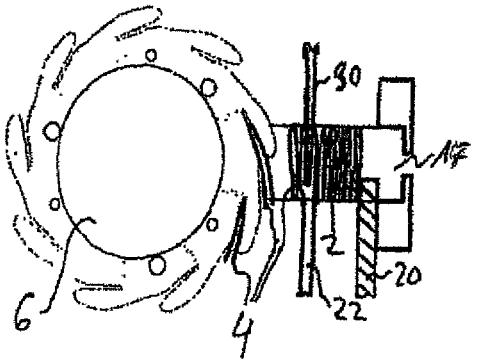
Figure 3E:
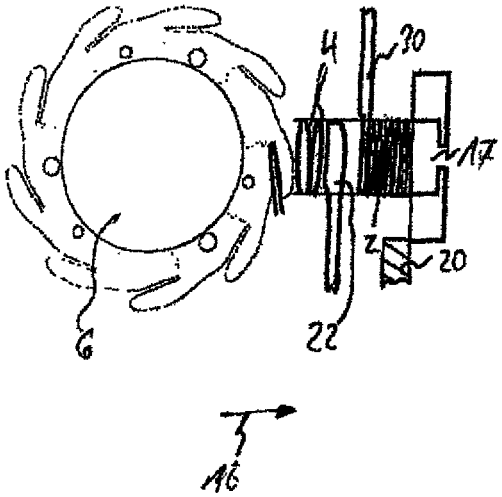

As can additionally be seen from the moment in FIG. 3*c*, the sliding element 30 is also supplied in sync with the movement sequences. In the moment according to FIG. 3*d*, the moment is shown at which the sliding element 30 is located in the same position as the separating element 22 and is also inserted between the product blanks 4. At this moment, in sync with the mentioned movements and adapted thereto, the channel wall 20 is opened so that the discharge channel 17 is freely accessible. In the subsequent step, as shown in the moment according to FIG. 3*e*, the sliding element 30 is moved towards the discharge channel 17 at a considerably increased speed by comparison with the separating element 22 in the conveying direction of the product blanks 4 which is indicated by the arrow 14, said channel now being completely released as a result of the channel wall 20 being completely open. The product stack 2 is thus inserted into the discharge channel 17 by means of the sliding element 30. In this phase, the separating element 22 which is moving comparatively slowly towards the discharge channel 17 takes over the function of the "movable rear wall" for the consecutive product blanks 4 and supports the rear side of the product blanks 4 which have already arrived and are forming the new product stack.

Figure 3F:
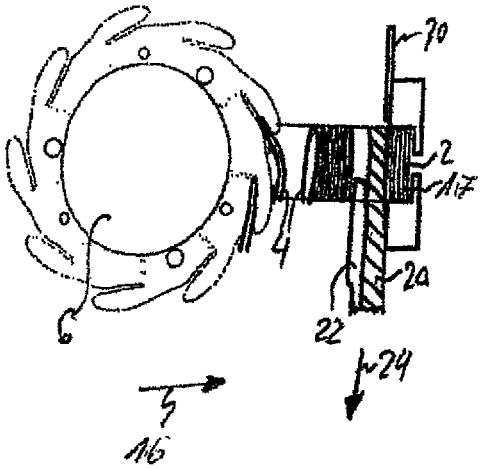

In a subsequent step, after the product stack 2 has been completely inserted into the discharge channel 17, and as is shown in the moment according to FIG. 3*f*, the channel wall 20 is closed again so that it is possible to remove the product stack 2 which has been introduced into the discharge channel 17. The sliding element 30 is now moved temporarily into an inoperative position. At this moment, as indicated by the arrow 24, the separating element 22 is removed downwards and out of the region of the product flow in the opposite direction to the insertion direction. The supporting function for the product stack being formed from the product blanks 4 can now be taken over again by the already closed channel wall 20. After the separating element 22 has been moved completely downwards and out of the region of the product flow, said element can be moved, under the product flow in the opposite direction to the conveying direction of the product flow which is indicated by the arrow 14, that is to say to the left in the embodiment according to FIG. 3*f*, back to the original position thereof. The state shown in FIG. 3*a* is thus assumed again, and the movement cycle can start anew.

As viewed from a lateral direction, the separating element 22 thus carries out a movement having a "rectangular" movement profile over the entire cycle, that is to say firstly the insertion movement into the product flow in a substantially vertical direction from the bottom up, then, in a position in which said element is inserted between two product blanks 4, the movement out of the way towards the channel wall 20 in a substantially horizontal conveying direction of the product blanks 4, subsequently the removal from the product flow in a substantially vertical direction from the top down, and lastly the backwards movement below the product flow in the opposite direction to the conveying direction of the product blanks 4 as far as to the insertion point.

What is claimed is:

1. A method for forming product stacks of folded or unfolded product blanks made of paper or chemical pulp, said method comprising:

supplying product blanks consecutively to a stacking surface and placing them in an upright position;

inserting a separating element between two consecutive product blanks as the product blanks are moved against a channel wall of a discharge channel for temporary support of a rear side of the product blanks, to thereby form a first product stack with a predetermined number of product blanks between the separating element and the channel wall;

opening the channel wall, thereby allowing the first product stack to be transferred to the discharge channel; and inserting a sliding element between the product stack and a subsequent second product stack, as the first product stack is moved to the discharge channel.

2. The method of claim 1, wherein the separating element is moved towards the channel wall after being inserted between the product blanks.

3. The method of claim 1, further comprising temporarily supporting a rear side of the second product stack by the separating element, as the first product stack is moved to the discharge channel.

4. The method of claim 1, further comprising grouping the product blanks together in two or more processing lines into plural product stacks which are jointly moved to the discharge channel.

5. A device for forming product stacks of folded or unfolded product blanks made of paper or chemical pulp, said device comprising:

a discharge channel having a movable channel wall;

a stacking surface arranged upstream of the discharge channel to allow a product stack to be transferred to the discharge wall, when the channel wall is temporarily moved to an open position; and a separating element configured for insertion between two product blanks, said separating element being movable in an insertion direction which is transverse to a conveying direction of the product blanks to the discharge channel.

6. The device of claim 5, wherein the separating element is configured for movement in a substantially horizontal conveying direction of the product stack.

7. The device of claim 5, further comprising a sliding element configured for movement in a substantially horizontal conveying direction of the product stack.

8. The device of claim 7, wherein the sliding element is configured for movement in the conveying direction of the product stack at a speed which is greater than a speed by which the separating element is moved.

9. The device of claim 7, wherein at least one of the sliding element and the separating element is configured in the form of a sliding rake or separating rake.

* * * * *